US008857616B2

(12) United States Patent
Olsen

(10) Patent No.: US 8,857,616 B2
(45) Date of Patent: Oct. 14, 2014

(54) REFERENCE APPARATUS

(71) Applicant: Jeffrey N Olsen, Wilsonville, OR (US)

(72) Inventor: Jeffrey N Olsen, Wilsonville, OR (US)

( * ) Notice: Subject to any disclaimer, the term of this patent is extended or adjusted under 35 U.S.C. 154(b) by 186 days.

(21) Appl. No.: 13/630,705

(22) Filed: Sep. 28, 2012

(65) Prior Publication Data

US 2013/0087606 A1 Apr. 11, 2013

Related U.S. Application Data

(60) Provisional application No. 61/544,136, filed on Oct. 6, 2011, provisional application No. 61/604,415, filed on Feb. 28, 2012.

(51) Int. Cl.

| | |
|---|---|
| ***B65D 85/00*** | (2006.01) |
| ***B42F 19/02*** | (2006.01) |
| ***B65D 5/50*** | (2006.01) |
| ***B42F 17/16*** | (2006.01) |

(52) U.S. Cl.

CPC ..... *B42F 17/16* (2013.01); *B42F 19/02* (2013.01); *B65D 5/5014* (2013.01)

USPC ..... 206/526; 206/39; 206/39.7

(58) Field of Classification Search

CPC ..... A45C 11/18; Y10S 283/904

USPC ..... 206/38, 39, 39.1, 39.7, 526, 102, 103

See application file for complete search history.

(56) References Cited

U.S. PATENT DOCUMENTS

| | | | | |
|---|---|---|---|---|
| 2,288,342 | A * | 6/1942 | Brooks | 206/103 |
| 3,655,119 | A * | 4/1972 | Thompson | 229/72 |
| 4,058,206 | A * | 11/1977 | Morse et al. | 229/241 |
| 2008/0066836 | A1 * | 3/2008 | Barnard | 150/139 |

* cited by examiner

*Primary Examiner* — David Fidei

(74) *Attorney, Agent, or Firm* — Kolisch Hartwell, PC

(57) ABSTRACT

Reference apparatus and storage and dispensing apparatus (such as for storing and/or dispensing the reference apparatus) are disclosed. In some embodiments, the reference apparatus may include a unitary planar material having a first panel, a second panel, and a third panel disposed between the first and second panels. The first and second panels may be configured to be folded between a folded position in which the first and second panels are parallel to the third panel, and an unfolded position in which the first and second panels are coplanar with the third panel relative to the folded position. One of the first and second panels may include an attachment portion configured to receive a receiving portion of the other of the first and second panels to secure the first, second, and third panels together in the folded position.

6 Claims, 3 Drawing Sheets

REFERENCE APPARATUS

CROSS-REFERENCE TO RELATED APPLICATIONS

This application claims priority to U.S. Provisional Patent Application Ser. No. 61/544,136, filed Oct. 6, 2011 and U.S. Provisional Patent Application Ser. No. 61/604,415, filed Feb. 28, 2012. The complete disclosures of the above applications are hereby incorporated by reference for all purposes.

BACKGROUND OF THE DISCLOSURE

A reference apparatus, such as a pocket guide or wallet guide, provides a user a convenient way to store valuable information. For example, a reference apparatus may be used to store medical and/or emergency information. The reference apparatus may be sized such that a person is more likely to carry the apparatus with him or her and have that apparatus available when needed. Additionally, the reference apparatus may be in a form that allows a person to easily add and/or delete information stored in or on the reference apparatus.

DETAILED DESCRIPTION OF THE DISCLOSURE

Figure 1:
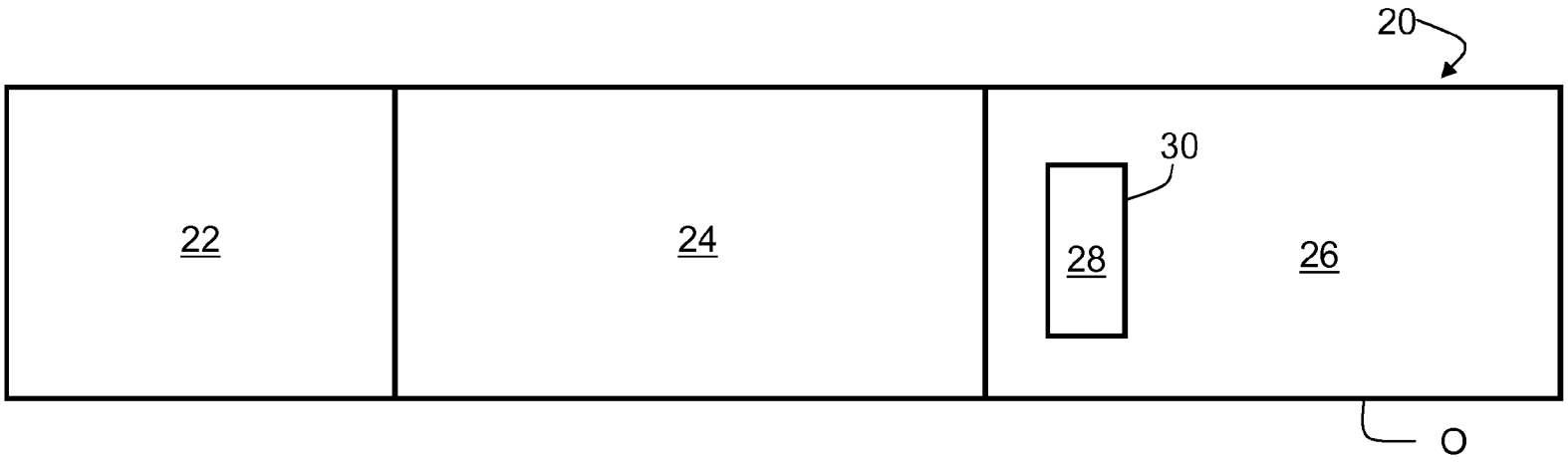
FIG. 1 is a schematic view of an example of a reference apparatus shown in an open position.
Figure 2:
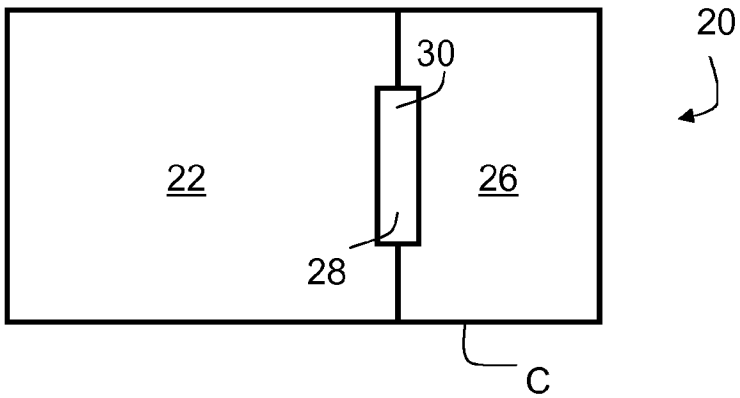
FIG. 2 is a schematic view of the reference apparatus of FIG. 1 shown in a closed position.
Figure 3:
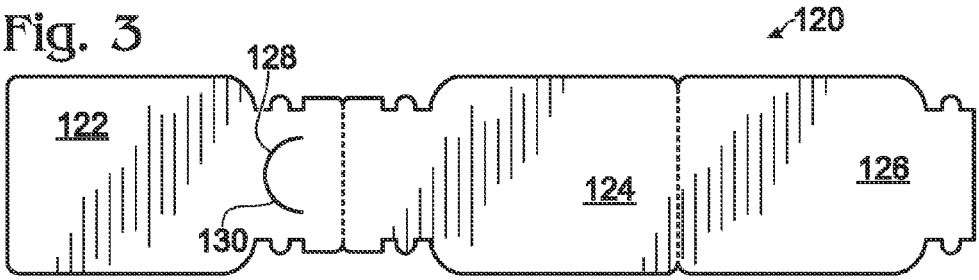
FIGS. 3-7 are various views of another example of the reference apparatus of FIGS. 1-2.
Figure 4:
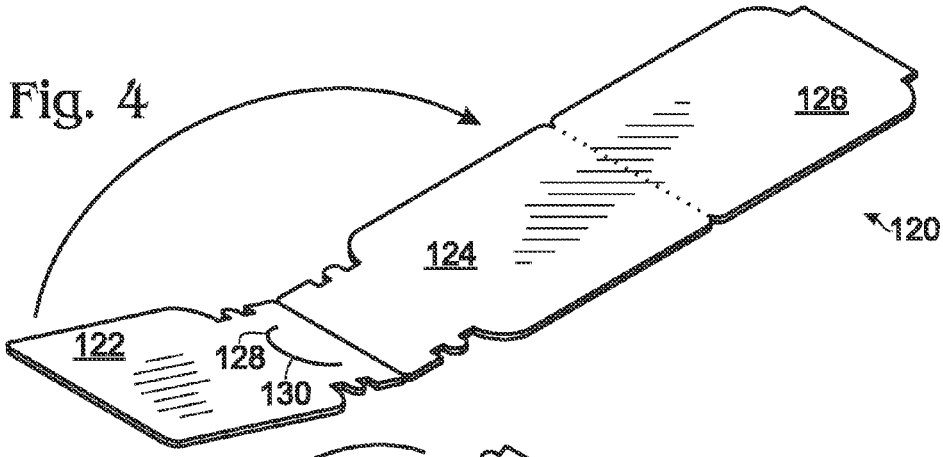
Figure 5:
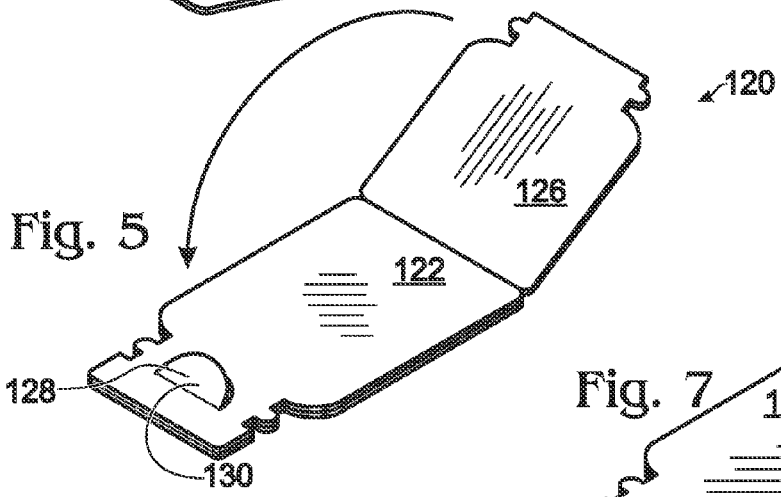
Figure 6:
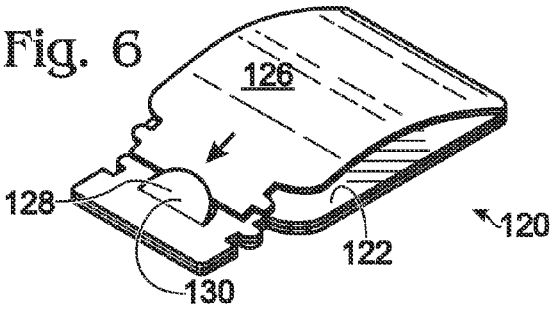
Figure 7:
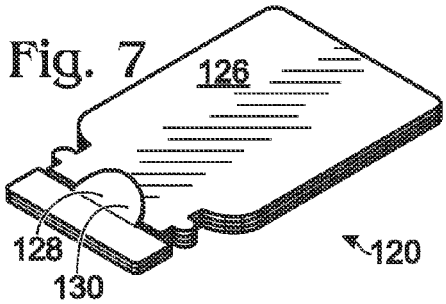

FIGS. 1-2 show an example of a reference apparatus 20. The reference apparatus may be made of one or more suitable materials. For example, the reference apparatus may be made of paper and/or cardboard. Alternatively, or additionally, the reference apparatus may include one or more polymer materials, such as one or more vinyl materials. The materials used may be of any suitable thickness. For example, when reference apparatus 20 is made of paper, the paper may have a thickness of 14-point C2S (coated two sides) or 12-point C2S. The thickness may be selected for durability of the reference apparatus.

Reference apparatus 20 may have any suitable dimensions. For example, the reference apparatus may sized to be contained in a wallet or purse, such as about 3⅜ inches by about 2 inches (or about 3 or 3½ inches by about 2 inches), or about the size of a credit card (85.60×53.98 millimeters). Additionally, the reference apparatus may include any suitable shape(s). For example, the reference apparatus may be rectangular, square, triangular, circular, etc. In some embodiments, the reference apparatus may be shaped to resemble any suitable objects, such as a pill bottle, a capsule, etc.

Reference apparatus 20 may include any suitable structure configured to store information. For example, the reference apparatus may include a left panel 22, a center panel 24, and a right panel 26. Although reference apparatus 20 is shown to include three panels, the reference apparatus may include two, four, five, six, or more panels.

One or more of the panels may be configured to facilitate folding of the panels between a plurality of positions, including an open position O (shown in FIG. 1) and a closed position C (shown in FIG. 2). Additionally, or alternatively, those panels may be configured to allow one or more of the panels to be secured together in the closed position. For example, left panel 22 may be sized smaller than the center and/or right panels, such as smaller in length and/or width than the center and/or right panels. Although left panel 22 is shown to be sized smaller than the center and right panels, and the center panel is sized about the same as the right panel, the left, center, and right panels may have any suitable dimensions. For example, both the left and right panels may be smaller than the center panel, such as smaller in length and/or width than the center panel.

Additionally, one or more of the panels (such as right panel 26) may include at least one attachment device 28, which may include any suitable structure configured to retain one or more of the panels in the closed position. For example, the attachment device may include at least one tab 30. The tab may be any suitable size. Additionally, tab 30 may be any suitable shape(s) configured to secure one or more of the panels in the closed position. For example, the tab may be rectilinear and/or curvilinear. In some examples, tab 30 may be formed by a slot in, for example, the right panel. The slot may be rectilinear and/or curvilinear. An example of a curvilinear slot is a half-moon slot. Moreover, tab 30 may include apertures (not shown) and/or other structure configured to prevent tearing or ripping of the slot.

Although right panel 26 is shown to include a single attachment device, the right panel may include two or more attachment devices, which may be in any suitable arrangement or orientation. Alternatively, or additionally, the left and/or center panels may include one or more attachment devices. In some embodiments, the attachment device(s) on one panel may interact with attachment device(s) of the other panel(s) to secure the one or more of the panels in the closed position. For example, center panel 24 may include, for example, an aperture (not shown) configured to receive tab 30 to secure the right panel to the center panel (or vice-versa) independent of the left panel.

Information, such as medical and/or emergency information, may be printed and/or written on one or more of the panels. For example, medications, allergies, and doctor names may be printed and/or written on one or more of the panels. Additionally, advertising information may be printed on a front panel (such as the left or right panel) when the reference apparatus is in the closed position.

In use, reference apparatus 20 may be moved to the open position to print and/or write information on one or more of the panels. The panels may then be folded to the closed position. For example, the right panel may be folded toward the center panel and the left panel may be folded toward the center panel. An edge of the left panel may be tucked under the tab of the right panel, which may secure the panels in the closed position. A user may then insert the reference apparatus in a wallet, purse, pocket, or other suitable container.

FIGS. 3-7 show another example of reference apparatus 20, which is generally indicated at 120. Related reference numbers are used (e.g., 22 and 122, 24 and 124, etc.) for features related to reference apparatus 20. Related features may be identical, similar, or dissimilar in different examples. For the sake of brevity, related features are not redundantly explained in the example of FIGS. 3-7. Instead, the use of related numbers shall cue the reader that the feature with a related number may be similar to the related features in reference apparatus 20.

Figure 8:
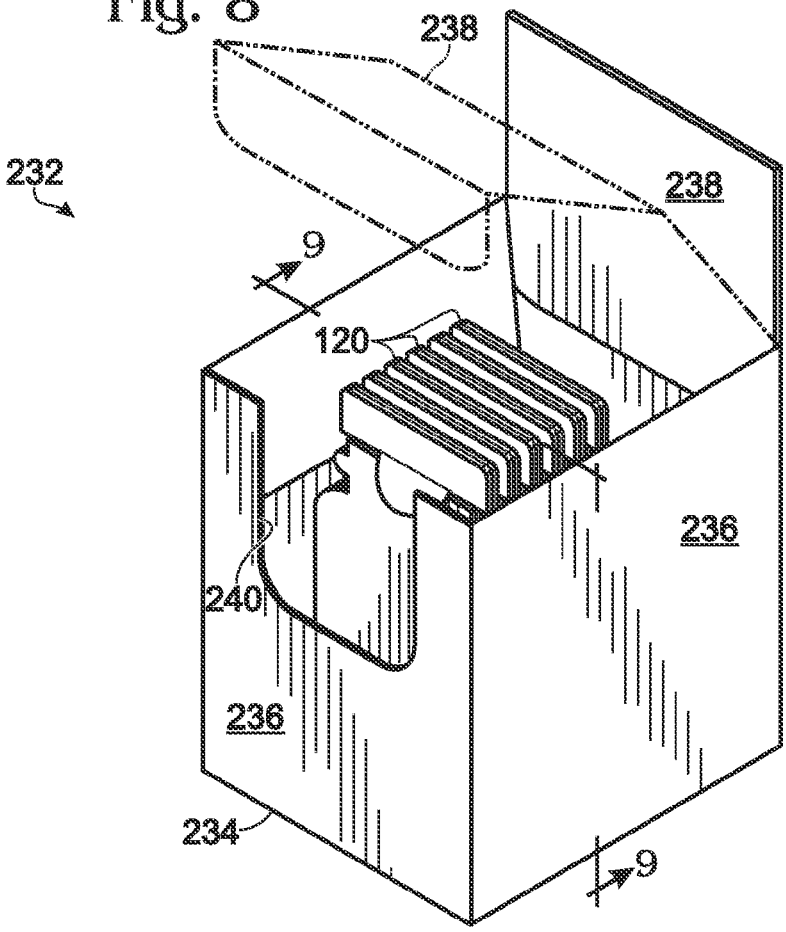
FIG. 8 is an isometric view of an example of a storage and dispensing apparatus for the reference apparatus of FIG. 1.
Figure 9:
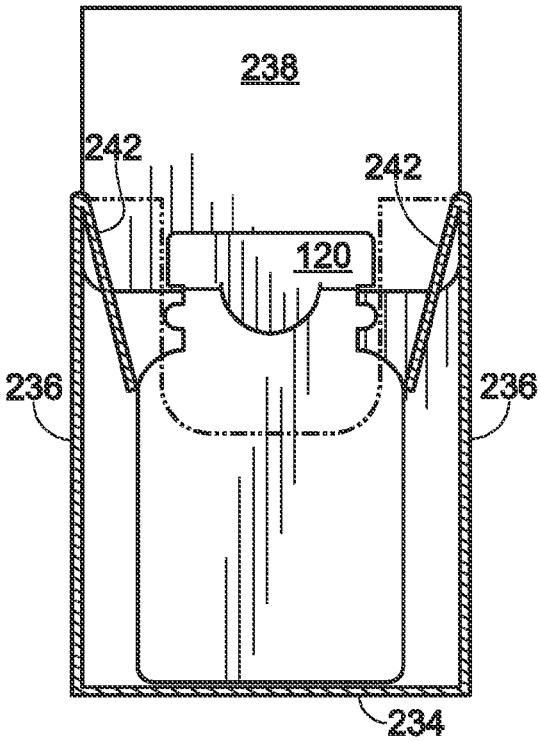
FIG. 9 is a sectional view of the storage and dispensing apparatus of FIG. 8 taken along lines 9-9 in FIG. 8.

FIGS. 8-9 show an example of a storage and dispensing apparatus 232 for reference apparatus 120. Although a specific example of a storage and dispensing apparatus for reference apparatus 120 is shown, the reference apparatus may be stored and/or dispensed in any suitable apparatus.

The storage and dispensing apparatus may include any suitable structure configured to store and/or dispense reference apparatus 20 or reference apparatus 120. For example, the storage and dispensing apparatus may include a bottom panel 234, a plurality of side panels 236, and a top panel 238 to form a box and/or other suitable shapes. The box may be any suitable shapes, such as a cube or rectangular prism. Alternatively, the panels may form a sphere, a pyramid, a tetrahedron, a cylinder, a cone, and/or other suitable shapes.

At least one of the side panels may include an aperture 240 sized to allow a user to obtain one or more of the reference apparatus from the storage and dispensing apparatus. Additionally, the aperture may be sized to display the reference apparatus when in the storage and dispensing apparatus. One or more of the side panels may include flap(s) 242 and/or other structure configured to provide tension to retain the reference apparatus in an upright position. For example, two of the side panels may include flaps. The top panel may cover the aperture and/or flaps when in a closed position.

The top panel may pivot into a plurality of intermediate positions, such as shown in dashed lines FIG. 8. Although the top panel is shown to be attached to a specific side panel, the top panel may be attached to any suitable side panel. The top panel also may be moved and/or folded into a dispensing and/or display position, such as shown in solid lines in FIG. 8. Information, such as advertising, medical, and/or emergency information, may be printed and/or written on one or more of the panels of the storage and dispensing apparatus.

In use, a plurality of reference apparatus may be placed in the storage and dispensing apparatus and the top panel moved to the closed position for transport and/or storage. When moved to a desired dispensing location, the top panel may be moved to the dispensing position, such as shown in FIG. 8, to allow patients and/or other users to remove a reference apparatus from the storage and dispensing apparatus. The storage and dispensing apparatus may be configured to be disassembled and/or unfolded, and then assembled and folded for use.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A kit, comprising:

a reference apparatus including a unitary planar material having:

a first panel, a second panel, and a third panel disposed between the first and second panels, wherein the first and second panels are configured to be folded between a folded position in which the first and second panels are parallel to the third panel, and an unfolded position in which the first and second panels are coplanar with the third panel, one of the first and second panels including a half-moon slot configured to receive an end portion of the other of the first and second panels to secure the first, second, and third panels together in the folded position, the first, second, and third panels being shaped to resemble a pill bottle when the first and second panels are in the folded position; and a storage and dispensing apparatus including a unitary planar material folded in the shape of a box to define an interior volume sized to contain a plurality of the reference apparatus, including:

a bottom panel, a plurality of side panels including a front side panel, a left side panel, a right side panel, and a rear side panel, and a top panel, wherein the top panel is configured to be folded between a closed position in which the top panel, the plurality of side panels, and the bottom panel encloses the interior volume, and a display position in which the top panel is folded into two portions such that (1) the interior volume is visible from external the storage and dispensing apparatus, (2) one of the two portions is parallel to the rear side panel, and (3) the other of the two portions is coplanar with the rear side panel, the left and right side panels including flaps that are configured to retain the plurality of reference apparatus in an upright position, the front side panel including an aperture to allow a user to view at least a portion of the interior volume from external the storage and dispensing apparatus when the top panel is not in the closed position, and the top panel including a flap configured to cover the aperture when the top panel is in the closed position.

2. A kit, comprising:

a reference apparatus including a unitary planar material having:

a first panel, a second panel, and a third panel disposed between the first and second panels, wherein the first and second panels are configured to be folded between a folded position in which the first and second panels are parallel to the third panel, and an unfolded position in which the first and second panels are coplanar with the third panel, one of the first and second panels including slot configured to receive an end portion of the other of the first and second panels to secure the first, second, and third panels together in the folded position; and a storage and dispensing apparatus including a unitary planar material folded in the shape of a box to define an interior volume sized to contain a plurality of the reference apparatus, including:

a bottom panel, a plurality of side panels including a front side panel, a left side panel, a right side panel, and a rear side panel, and a top panel, wherein the top panel is configured to be folded between a closed position in which the top panel, the plurality of side panels, and the bottom panel encloses the interior volume, and a display position in which the top panel is folded into two portions such that (1) the interior volume is visible from external the storage and dispensing apparatus, (2) one of the two portions is parallel to the rear side panel, and (3) the other of the two portions is coplanar with the rear side panel, the left and right side panels including flaps that are configured to retain the plurality of reference apparatus in an upright position.

3. The kit of claim 2, wherein the slot is shaped as a half-moon slot.

4. The kit of claim 3, wherein the first, second, and third panels are shaped to resemble a pill bottle when the first and second panels are in the folded position.

5. The kit of claim 2, wherein the front side panel includes an aperture to allow a user to view at least a portion of the interior volume from external the storage and dispensing apparatus when the top panel is not in the closed position.

6. The kit of claim 5, wherein the top panel includes a flap configured to cover the aperture when the top panel is in the closed position.

* * * * *